US011649597B2

(12) United States Patent
Zipes et al.

(10) Patent No.: US 11,649,597 B2
(45) Date of Patent: May 16, 2023

(54) SELF-PROPELLED STREET CLEANER

(71) Applicant: BUCHER MUNICIPAL AG, Niederweningen (CH)

(72) Inventors: Alexander Zipes, Ennetbaden (CH); Thomas Zimmermann, Klettgau (DE)

(73) Assignee: BUCHER MUNICIPAL AG, Niederweningen (CH)

( * ) Notice: Subject to any disclaimer, the term of this patent is extended or adjusted under 35 U.S.C. 154(b) by 433 days.

(21) Appl. No.: 15/930,659

(22) Filed: May 13, 2020

(65) Prior Publication Data

US 2020/0362526 A1 Nov. 19, 2020

(30) Foreign Application Priority Data

May 13, 2019 (CH) ..... 00626/19

(51) Int. Cl.
*E01H 1/08* (2006.01)

(52) U.S. Cl.
CPC ..... *E01H 1/0845* (2013.01); *E01H 2001/089* (2013.01)

(58) Field of Classification Search
CPC .... E01H 1/08; E01H 1/04; E01H 1/02; E01H 2001/0881; E01H 1/0836; E01H 1/0827;
(Continued)

(56) References Cited

U.S. PATENT DOCUMENTS 7,607,195 B2 10/2009 Tagliaferri
8,806,704 B2 8/2014 Wahl

FOREIGN PATENT DOCUMENTS

CN 104594268 A 5/2015
CN 105465015 A 4/2016
(Continued)

OTHER PUBLICATIONS

European Search Report, EP20405016, dated Sep. 21, 2020, 3 Pages.

(Continued)

*Primary Examiner* — Katina N. Henson
(74) *Attorney, Agent, or Firm* — Lucas & Mercanti, LLP; Klaus P. Stoffel

(57) ABSTRACT

A self-propelled sweeping machine, having a chassis comprising at least one driven drive axle with wheels, for cleaning drivable, preferably solid, ground surfaces such as roads, streets, paths and cycle paths, squares or the like, consists of a refuse collection container which is built onto the chassis for receiving refuse which is lifted from the ground surface by means of generated suction air and/or suction force of a suction air unit comprising a suction air blower, by a suction device provided at the front end of a suction air line, and which is supplied via the connected, preferably rising, suction air line to the interior of the refuse collection container, wherein the refuse collection container has a screening device which is arranged spaced apart from the upper container wall for separating the refuse and, for conducting the suction air, has a downstream air outlet line for the suction air to be discharged, and wherein for the emptying process the refuse collection container is configured at the rear end so as to be pivotable about a horizontal axis arranged transversely to the forward direction of movement, and for emptying refuse the inner face of the rear wall of the refuse collection container is configured as a sliding surface which rises, respectively is inclined, to the rear, wherein the suction air unit, which is line-connected by a suction air opening to the interior of the refuse collection container, is arranged on the outer face of the rear wall of the refuse collection container configured with an internal sliding surface.

14 Claims, 3 Drawing Sheets

(58) Field of Classification Search
CPC ..... E01H 2001/089; E01H 1/0845; E01H 1/0809
USPC ..... 15/340.3
See application file for complete search history.

(56) References Cited

FOREIGN PATENT DOCUMENTS

| | | | |
|---|---|---|---|
| DE | 202012103471 | U1 | 10/2012 |
| DE | 102013204406 | B1 | 9/2014 |
| EP | 0621376 | B1 | 10/1994 |
| EP | 2299000 | A2 | 3/2011 |
| EP | 2821553 | A1 | 1/2015 |
| EP | 2880221 | B1 | 1/2017 |
| FR | 1366013 | A | 7/1964 |
| FR | 2912433 | A1 | 8/2008 |
| GB | 2420813 | A | 6/2006 |
| RU | 2413048 | C2 | 2/2011 |
| RU | 155390 | U1 | 10/2015 |
| RU | 2614878 | C1 | 3/2017 |
| SU | 1397588 | A1 | 5/1988 |
| WO | 2010105639 | A1 | 9/2010 |

OTHER PUBLICATIONS

Excerpt of Swiss Search Report, CH00626/19, dated Jun. 14, 2019, 2 pages.
Excerpt of Russian Search Report, RU2020114738, dated Apr. 27, 2020, 2 pages.

SELF-PROPELLED STREET CLEANER

CROSS-REFERENCE TO RELATED APPLICATIONS

The present application claims priority of CH 00626/19, filed May 13, 2019, the priority of this application is hereby claimed and this application is incorporated herein by reference.

BACKGROUND OF THE INVENTION

The invention relates to a self-propelled sweeping machine, having a chassis comprising at least one driven drive axle with wheels, for cleaning drivable, preferably solid, ground surfaces such as roads, streets, paths and cycle paths, squares or the like, having a refuse collection container which is built onto the chassis for receiving refuse which is lifted from the ground surface by means of generated suction air and/or suction force of a suction air unit comprising a suction air blower or the like, by a suction device, and which is supplied via the connected, preferably rising, suction line to the interior of the refuse collection container, wherein the refuse collection container has a screening device which is arranged spaced apart from the upper container wall for separating the refuse and, for conducting the suction air, has a downstream air outlet line for the suction air to be discharged and wherein for the emptying process the refuse collection container is configured at the rear end so as to be pivotable about a horizontal axis arranged transversely to the forward direction of movement F and, for promoting the emptying of refuse, the inner face of the rear wall of the refuse collection container is configured as a sliding surface which rises, respectively is inclined, to the rear.

In this case, the suction air/suction force which is generated and/or brought about by the suction air unit on the suction device is conducted back by the suction air unit/suction air blower from the refuse collection container to the surroundings, to which end the suction air unit, respectively the suction air blower, has an intake opening which is line-connected to the refuse collection container and an air outlet opening which is connected to the surroundings.

If the chassis of the sweeping machine is in one piece and is provided with at least four wheels, the wheels which respectively form a front axle and a rear axle are steered in pairs.

In a two-part chassis, the front and the rear chassis parts are pivotably connected about vertical axes by actuatable piston cylinder units for steering the sweeping machine.

In EP 0 621 376 B1 a self-propelled, steerable road sweeping machine with a suction blower, a suction device and a refuse container are disclosed and shown, said refuse container being connected through an inlet opening by means of a rising suction line to the suction device with a conveying action, wherein the intake opening of the suction blower is mounted in the upper part of the refuse container and oriented upwardly and as a result it has proved expedient to arrange said suction blower centrally relative to the length and width in the upper part of the refuse container and to have a dividing grille or screen above the intake opening of the suction blower for the refuse to be screened and the drive motor of the suction blower in the refuse container.

DE 10 2013 204 406 B1 discloses a drivable ground cleaning machine with a two-part chassis articulated about a vertical axis, for advancing over a surface to be cleaned. A dirt container is fastened to the rear chassis part for receiving dirt which is suctioned by a suction apparatus from the surface to be cleaned, wherein the suction apparatus is connected to the dirt container via a rising suction line which extends centrally into the dirt container, viewed transversely to the direction of travel. Means are provided for generating an airflow from the suction apparatus through the suction line into the dirt container and a baffle plate widening via the outlet opening of the suction line in the dirt container, said baffle plate separating the exiting airflow into two partial flows running along the upper face of the dirt container. The fan generating the suction air is arranged in the front upper region of the dirt container downstream of the suction line and the driver's cab and is fastened to a second portion of the baffle plate. This guidance of the suction air takes up a large part of the interior of the dirt container.

WO 2010/105639 A1 relates to a self-propelled sweeping machine which is articulated on a longitudinal axis, having wheels for moving along a ground surface, having a sweeping brush which is drivable in a rotational manner for sweeping the ground surface and a dirt container which is supplied with a vacuum via a suction channel by a suction system and is connected via a suction line to a suction port for receiving refuse.

SUMMARY OF THE INVENTION

The object of the present invention is that the collection chamber/hollow chamber of the refuse collection container is intended to be optimized, whilst the external contours remain the same, and is intended to correspond to a common power demand for the sweeping machines which optimizes the period of use of the machine before the refuse collection container is emptied in a (remotely located) disposal site.

The improvement in the efficiency and the noise emissions also form part of the object of a sweeping machine to be developed further. Both are intended to be brought about by a more advantageous design of the operating system in terms of flow technology, for example by preventing sudden cross-sectional alterations, so that flow separations are avoided.

According to the invention, the object has been achieved in that the suction air unit, flow machine or ventilating fan, which is line-connected by a suction air opening to the interior of the refuse collection container, is arranged on the outer face of the rear wall of the refuse collection container provided with an internal sliding surface.

As a result, a greater useable volume, respectively an increase in production, may be achieved whilst the existing external contours remain the same.

It also proves advantageous if the upper container wall is line-connected to the adjacent screening device forming a first portion, arranged upstream of the suction air unit, of an air outlet line which is connected to the suction air unit for the suction air separated from the refuse.

As a result, the refuse collection container may be filled with a uniform distribution and additional noise emissions may be eliminated.

If a second portion which is positioned downstream of the suction air unit forms the outlet opening at the end of the air outlet line, an advantage may be achieved by, for example, the risk of a blockage in the air outlet region and the deposit of dust and water being reduced by a long (grooved) screen surface of the screening device opposite the upper container wall.

It is advantageous if the second portion of the air outlet line, which is positioned downstream, terminates downstream of the suction blower below the refuse collection container, so that no undesired disruptive factors, such as for example additional noise emissions, are produced.

Preferably, the second portion of the air outlet line runs on the lower face of the refuse collection container and may be fastened there in a manner which is protected, insulated from noise and unobtrusive.

It proves expedient if the outer face of the rear wall of the refuse collection container is configured for arranging an intermediate portion of the air outlet line, which is formed from the line-connected suction air unit, the first and second portion, resulting in a type of arrangement which facilitates the access and the user-friendliness of the claimed components of the air distribution system.

In the suction air unit comprising a rotating suction air blower, or a further generator producing suction air, a rotational axis of the impeller may be arranged perpendicular to the inclined rear wall of the refuse collection container on the rear wall outer face, so that a compact and protected arrangement of the relevant system parts may be produced on the rear wall outer face.

It may be expedient to provide an intake opening of the suction air blower in the intermediate portion of the air outlet line formed by the suction air unit, upstream of the suction air blower, said intermediate portion forming a significant portion of the suction air system.

It is advantageous if the intake opening of the suction air blower is assigned to the first portion of the air outlet line which permits a simple line connection.

Accordingly, it is expedient if an air outlet opening, which is offset in the air outlet line relative to the intake opening and line-connected to the second portion of the air outlet line downstream of the suction air blower, is assigned to the suction air blower, whereby the air guidance may be optimized in terms of flow technology.

Preferably, the upper container wall forming part of the first portion of the air outlet line—the portion which is widened out in a planar manner—and the screening device are arranged on a container cover which is provided for emptying the refuse collection container, which is configured so as to be pivotable about a horizontal axis oriented transversely to the forward direction of movement F and which has a line connection which is able to be separated from the intermediate portion of the air outlet line, wherein in the container cover region a planar flow cross section of broad design may be produced thereby.

If the intermediate portion of the air outlet line is configured by a chute which is arranged on the outer face of the rear wall upstream of the suction air blower, respectively the intake opening thereof, and which extends so as to taper downwardly and/or toward the intake opening, this results in a design of the system parts relating to the air outlet line portions and the suction air unit which is advantageous in terms of flow technology.

In the context of an assisted screening of the solid parts in the refuse collection container, an outlet diffusor protruding into the refuse collection container and deflecting the suction air to the container floor is arranged on the conveying end of the suction line, said outlet diffusor expanding and depressurizing the conveying flow.

The outlet diffusor extending at least partially over the width of the refuse collection container is configured to be open on its lower face in order to optimize the effect thereof.

In order to be able to act more effectively on the deflection of the airflow, a pivotable flap extending the air guidance is arranged so as to adjoin the outlet diffusor.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
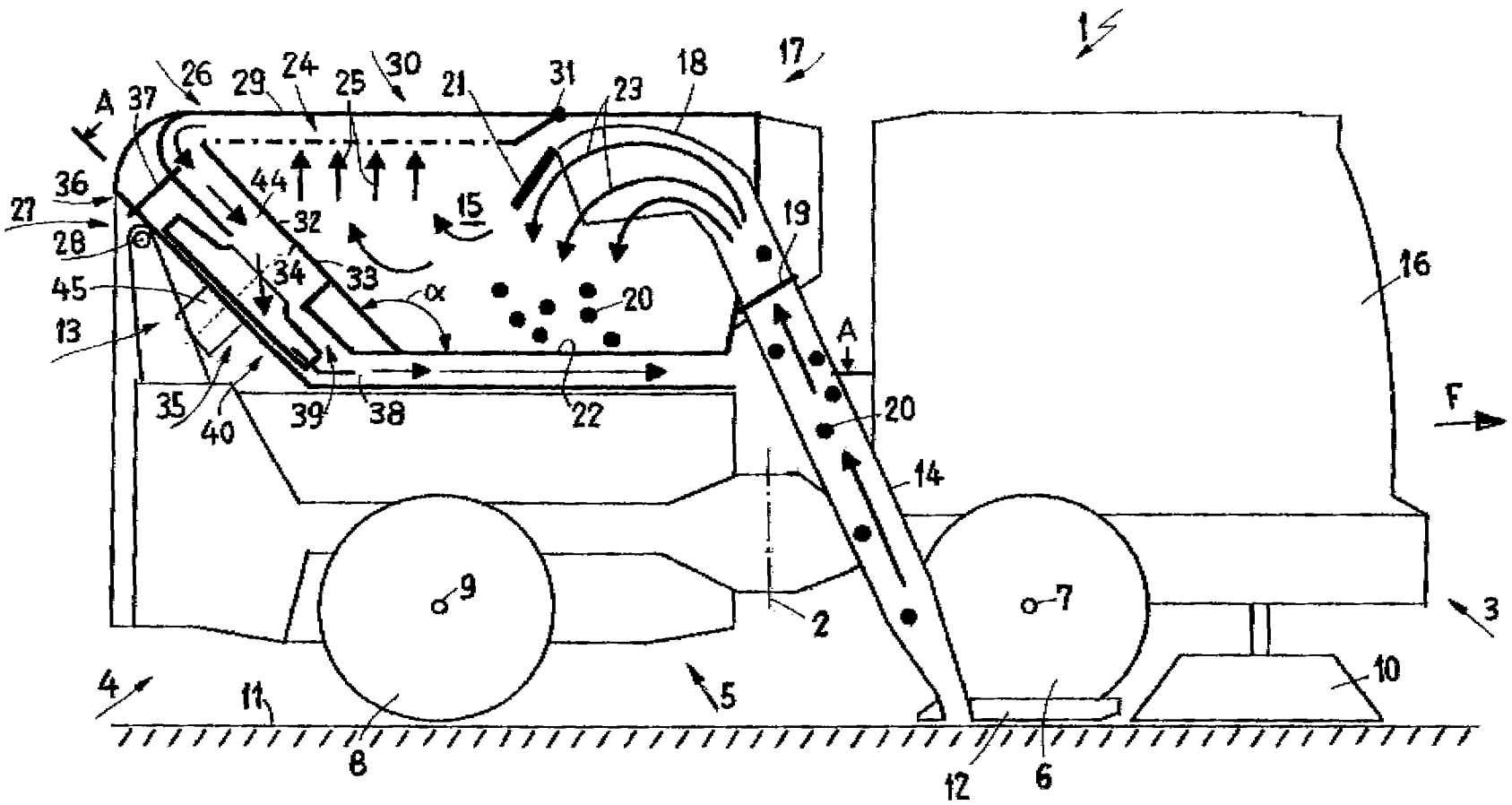
FIG. 1 shows schematically a longitudinal section through a sweeping machine according to the invention which is located on a ground surface.

FIG. 1 illustrates a self-propelled sweeping machine 1 having one of two chassis parts 3, 4 of a chassis 5 connected to a vertical pivot axis 2. The front chassis part 3 has a drive axle 7 made up of two wheels 6 which are steerable together, whereas the wheels 8 of the rear chassis part 4 are mounted on a rigid drive axle 9, wherein only the one wheel of an axle is shown in each case in FIG. 1.

The working and/or forward direction of movement of the 1 is denoted in FIG. 1 by F.

On the front chassis part 3 in each case a sweeping brush 10, rotating on the ground surface, is mounted upstream of the front wheels 6, said sweeping brush(es) 10 being drivable in a rotational manner by means of the motor about an approximately vertical axis.

The sweeping brushes 10 sweep the refuse located on the ground surface 11 onto/below a suction device 12 which suctions the refuse from the ground surface 11 and, via a suction line (riser line) 14 connected to a suction air unit 13, conveys the refuse by means of the airflow into a refuse collection container 15 placed on the rear chassis part 4 of the chassis 5.

A driver's cab 16 is fastened on the front chassis part 3 of the chassis 5, an operator operating the sweeping machine 1 therein.

The rear chassis part 4 has a structure 17 which—in the present case substantially—consists of the refuse collection container 15 serving to receive the refuse conducted via the suction line 14, and the suction air unit 13 connected thereto with a conveying action as well as an air outlet line 26. The built-on refuse collection container 15 receives the refuse which, lifted by the suction device 12 from the ground surface 11, is subsequently conveyed via the rising suction line 14—the conveying end thereof preferably having an outlet diffusor 18 feeding into the container 15—by means of the vacuum/low pressure conditions generated by the suction air unit 13.

The outlet diffusor 18 assists the separation of the refuse from the suction air by depressurizing/expanding the suction air in the refuse collection container 15 and to this end has a cross section which continuously widens in the direction of the airflow and which may advantageously extend at least approximately over the width of the refuse collection container.

In the context of an expansion of the airflow at the conveying end of the suction line 14 protruding into the refuse container, the outlet diffusor 18 is configured in the manner of a hood and/or to be open downwardly.

Preferably, the diffusor 18 forms a curved end of the air line 14 protruding into the refuse collection container 15—a manifold—which is fastened to the refuse collection container 15, and for emptying the refuse collection container has a separating point 19 which is preferably located outside the refuse container 15 and by which the diffusor 18 is separated from the suction line 14 when the refuse collection container 15 is emptied.

The dot-shaped elements 20 are individual, respectively solid, parts of the received refuse or dirt shown symbolically.

At the upper end of the diffusor outlet which extends at least partially over the width of the refuse collection container 15, a pivotably adjustable flap 21 serving as a guide element, respectively deflection element, deflects the solid parts of the refuse striking thereon toward the floor 22 of the refuse collection container 15 and exerts a damping action on the airflow. The arrows 23 show approximately the flight path of the solid parts dropping in the refuse collection container 15 after leaving the diffusor 18, respectively the suction line 14.

The refuse collection container 15 naturally has an air outlet line leading to an outlet opening for the suction air, which is described below (see FIG. 2).

In the upper container region a permeable screening device 24, for example a screen or similar acting device, is arranged below the upper container wall 29 of the refuse collection container 15, through which screening device the conveyed suction air—shown by arrows 25—flows out of the refuse collection container 15 into the air outlet line 26 which subsequently extends further. This suction air passes along the rear wall 32/air outlet line 26 via a chute 44, which is line-connected to the screening device 24, tapering toward the intake opening 43 of the suction air unit 13 and/or the suction air blower 40, wherein the chute 44 is arranged between the rear wall 32 of the refuse collection container 15 and the suction air unit 13 and/or the suction air blower 40.

Figure 4:
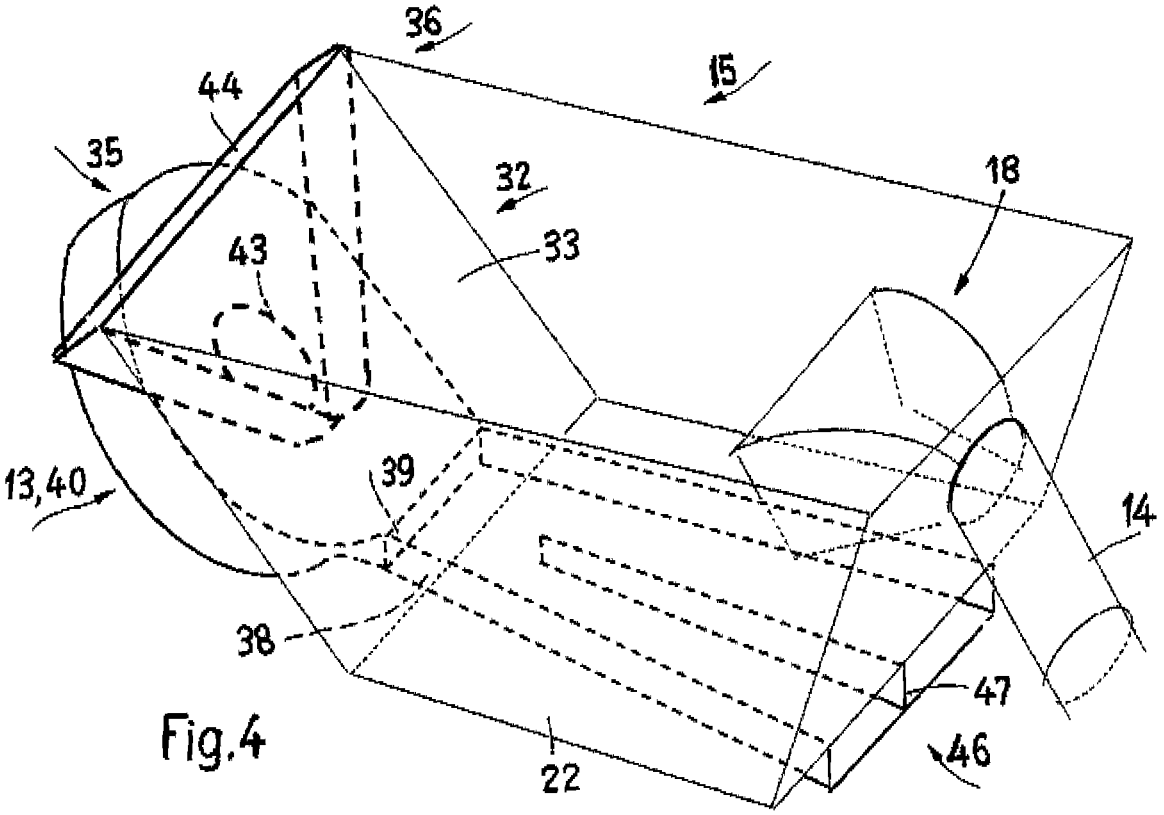
FIG. 4 shows in detail a view of the open refuse collection container from above and FIG. 5 shows in detail a section through the refuse collection container along the line A-A in FIG. 1.

FIG. 4 facilitates a view into the open refuse collection container 15 and shows where the suction line 14 which is connected to the front container wall 48 is fastened and the conveying end of said suction line to which the outlet diffusor is fastened.

Moreover, FIG. 4 shows on the opposing container end the rear wall 32 which is configured on the inner face with a sliding surface 33. The first portion 36 of the air outlet line 26 running on the rear wall outer face 34 feeds via the chute 44 into the suction air unit 13, respectively the suction air blower 40, at the intake opening 43. The suction air collected by the suction air unit 13, respectively the suction air blower 40, downstream of the first portion 36 of the air outlet line 26 is discharged outwardly via the air outlet opening 39 of the suction air unit 13/suction air blower 40 into the second portion 38 of the air outlet line 26 downstream of the suction air unit 13/suction air blower 40. The second portion 38 is predominantly located below the refuse collection container 15 and extends as far as the front container floor end.

Figure 2:
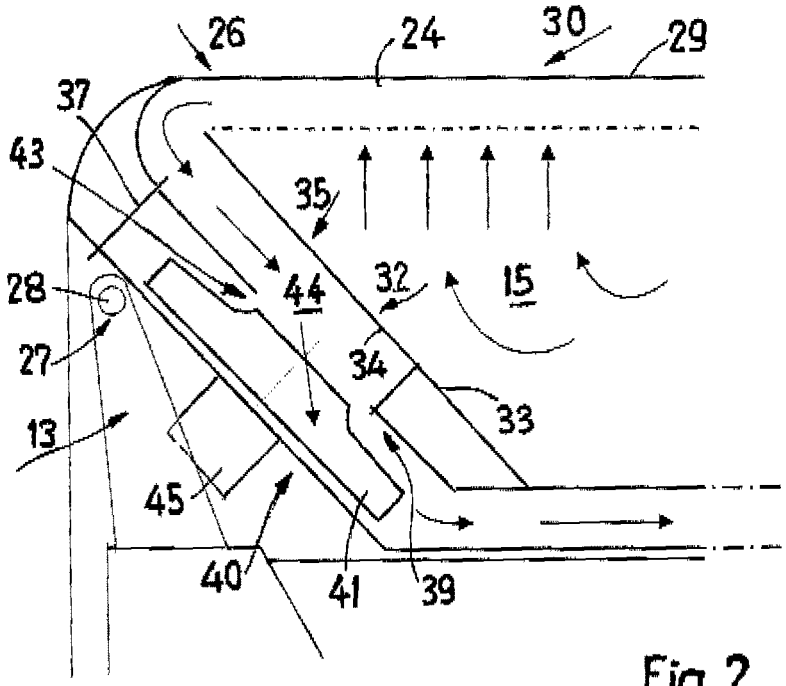
FIG. 2 shows schematically an enlarged detail of FIG. 1 with an airflow which is brought together on the rear wall of a refuse collection container and a suction air outlet line as well as a suction air unit.
Figure 3:
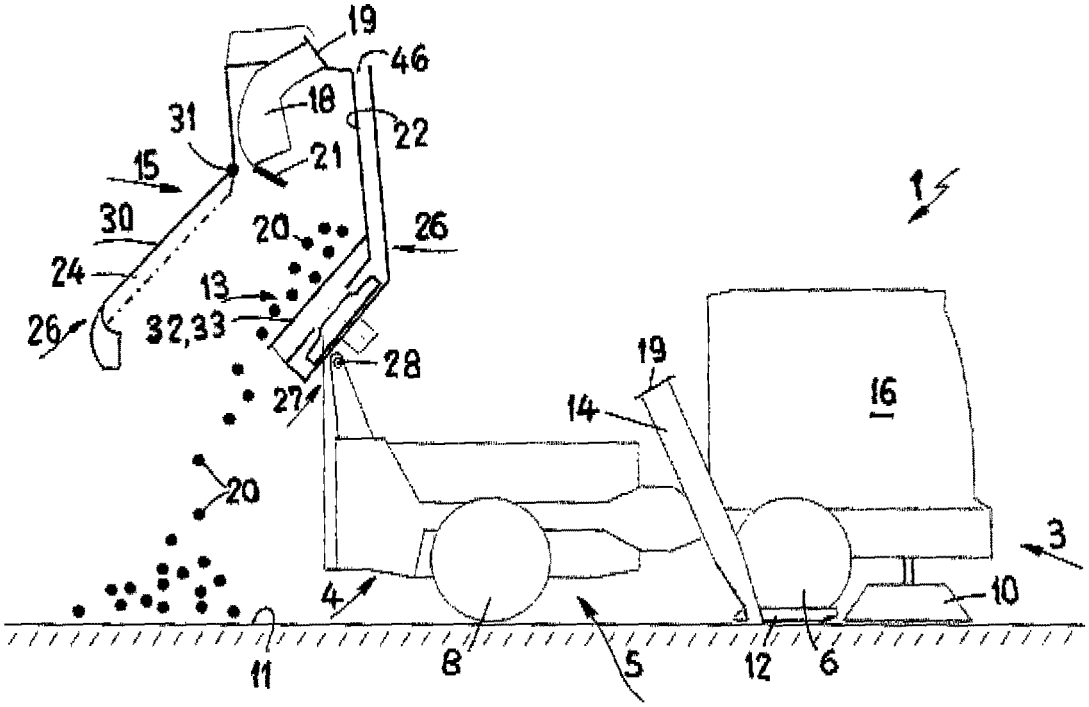
FIG. 3 shows schematically a view of the sweeping machine according to FIG. 1 in the emptying position of the refuse collection container.

The refuse collection container 15 is provided at its rear end in the working, respectively forward, direction of movement F, preferably in the upper container region, with a pivoting device 27 which is connected to the rear chassis part 4 of the chassis 5 of the sweeping machine 1 or sweeping vehicle, and which permits the refuse collection container 15 to be lifted up from the chassis part 4 about a horizontal pivot axis 28 extending transversely to the forward direction of movement F into an emptying position (see FIGS. 1 to 3).

For emptying the container, a part of the upper container wall 29 (container top) of the refuse collection container 15 extending to the rear is configured as a container cover 30 which also serves for fastening and/or arranging the screening device 24 and at the end facing the driver's cab 16 is pivotable about a horizontal axis 31 oriented transversely to the forward direction of movement F.

The screening device 24 which is connected to the container cover 31 also forms part of the air outlet line 26 which is line-connected to the first portion of the air outlet line 26 upstream of the suction air unit 13 and/or the suction air blower 40.

The rear wall 32 which is fixedly connected to the refuse collection container 15 is configured in the working position of the sweeping machine 1 and/or the refuse collection container 15 as a sliding surface 33 rising to the rear, at an angle $\alpha$ of approximately 135° to the container floor 22. The angle $\alpha$ could also be configured differently from 135° in order to be able to ensure the slidability of the refuse in the emptying position.

The suction air unit 13 is arranged on the rear wall outer face 34 of the rear wall 32 of the refuse collection container 15 which, for the emptying process, is configured on the inner face as a sliding surface for the refuse received.

Moreover, the rear wall outer face 34 of the refuse collection container 15 is suitable for forming an intermediate portion 35 of the air outlet line 26 connected to the suction air unit 13, the first portion 36 of the air outlet line 26 being arranged upstream thereof, and the part comprising the screening device 24 also forming part thereof. By opening the container cover 30 for emptying the refuse collection container 15, the part comprising the screening device interrupts the air outlet line 26 at the releasable connecting point 37 between the first portion 36 and the intermediate portion 35 of the air outlet line 26, respectively the air conducting line, after the exit of suction air from the refuse collection container 15.

The air outlet line 26 downstream of the intermediate portion 35, which is assigned to the suction air unit 13 suction air blower 40, consists of a second portion 38 of the air outlet line 26 positioned downstream and/or arranged downstream, an air outlet opening 46 being provided at the end thereof.

The second portion 38 of the air outlet line 26 runs below the refuse collection container 15 and terminates at the front end thereof in the forward direction of movement of the sweeping machine.

The suction air unit 13 preferably has a rotating suction air blower 40 with a rotating impeller 41 which provides the suction air, respectively the suction force, in the refuse collection container 15 and in the suction line 14, as well as the suction device. The rotational axis of the impeller 41 of the suction air blower 40 which is driven by means of an electric motor is oriented at least approximately perpendicular to the rear wall 32 of the refuse collection container 15 and the suction air flows under vacuum conditions from the suction device 12 to the suction air unit 13, toward the outside via said suction air unit and the second portion 38 of the air outlet line 26.

FIG. 2 shows in an enlarged view relative to FIG. 1 the type of arrangement of the suction air unit 13 on the outer face of the rearwardly inclined rear wall of the refuse collection container 15. The suction air unit 13 is arranged in an intermediate portion 35 of the air outlet line 26 between the first 36 and second portion 38 and has a suction air blower 40 which is connected by an intake opening 43 to the first portion 36, on the one hand, and by an air outlet opening 39 to the second portion 38, on the other hand, of the air outlet line 26.

The drive of the suction air blower 40 which comprises an impeller 41 is provided, for example, by an electric motor 45.

Moreover, FIG. 2 shows the connecting point and/or separating point 37 between the upper container wall 29 formed by a pivotable container cover 30 intended for emptying the refuse collection container 15 and the suction air unit 13 fastened to the rear wall 32 of the refuse collection container 15. The suction airflow in the air outlet line 26 is shown by arrows.

In FIG. 3 an emptying situation is shown in which the refuse collection container 15 is tipped up about the pivot axis 28 and the container cover 30 is pivoted up about the parallel horizontal axis 31 so that the refuse collection container 15 is emptied via the inner sliding surface 33 of the rear wall 32. FIG. 3 illustrates the open separating point 19 of the suction line 14. The tipping up and opening as well as the resetting of the refuse collection container 15 and container cover 30 into the operating state is carried out, for example, by hydraulic cylinders.

Figure 5:
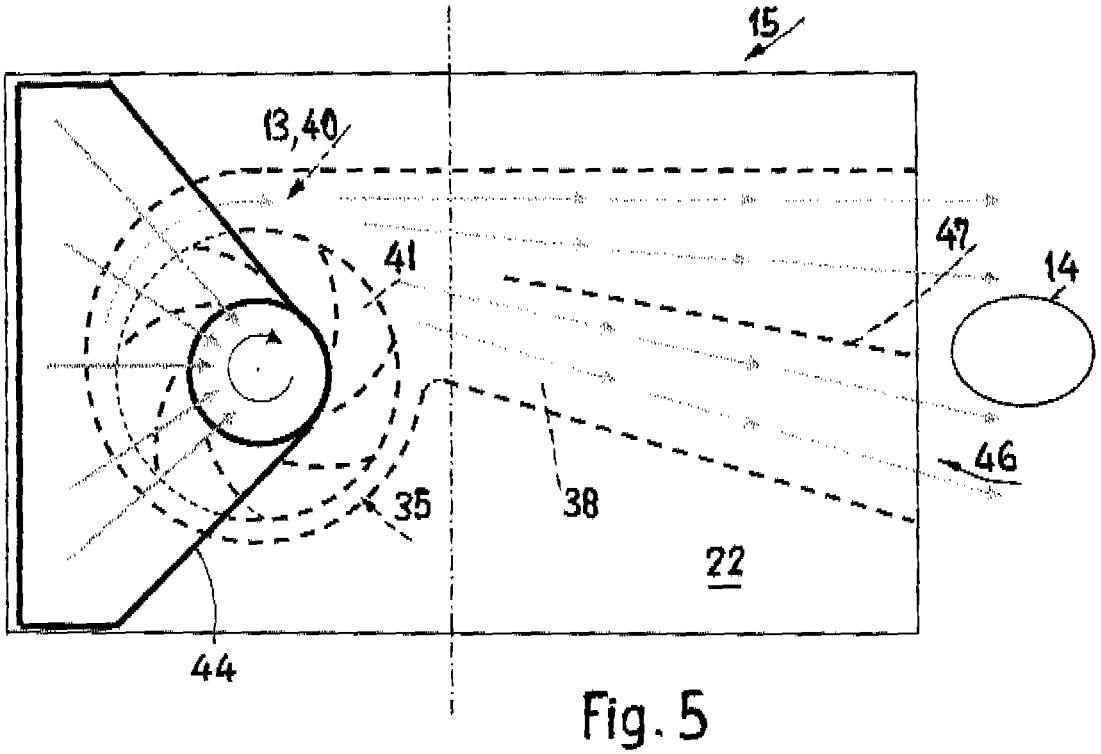

FIG. 5 facilitates a view of the refuse collection container 15 along the line A-A in FIG. 1 as well as the flow direction of the suction air in the chute 44—part of the air outlet line 26—which is arranged on the rear wall 32 of the refuse collection container 15 and which is line-connected at the end on the tapered outlet side to the suction air blower 40 as well as the second portion 38 of the air outlet line 26 and to the opposing first portion 36 of the air outlet line 26. The second portion 38 of the air outlet line 26 downstream of the suction air unit 13/suction air blower 40 is equipped with separating elements 47 arranged in the flow direction.

The suction air which is loaded with refuse and processed in an overshot conveying region and which is produced on the suction device 12 above the ground surface 11 and flows further downstream of the rising suction line 14 into the air outlet line 26 on the upper container wall 29, which is configured at the start as a screening device 24, and which is to be separated from the refuse and to be depressurized, respectively expanded, is deflected at the rear end of the refuse collection container 15 from the upper container wall 29 downwardly into the first portion 36 of the air outlet line 26 along the outer face of the inclined rear wall 32 of the refuse collection container 15 and reaches the intermediate portion 35 of the suction air blower 40 of the suction air unit 13, in which the suction air is conveyed by the suction air blower 40 into the second portion 38 which is arranged downstream of the suction air unit 13 and which is widened toward the air outlet opening 46 of the air outlet line 26.

While specific embodiments of the invention have been shown and described in detail to illustrate the inventive principles, it will be understood that the invention may be embodied otherwise without departing from such principles.

We claim:

1. A self-propelled sweeping machine for cleaning drivable ground surfaces, comprising: a chassis having at least one driven drive axle with wheels; a refuse collection container built onto the chassis; a suction air unit having a suction air blower; a suction air line that leads to an interior of the refuse collection container; a suction device provided at a front end of the suction air line for lifting refuse from the ground surface by the suction device generated suction air or suction force of the suction air unit; and, a screening device arranged in the refuse collection container so as to be spaced apart from an upper container wall for separating the refuse, the upper container wall having a downstream air outlet line for conducting the suction air to be discharged, wherein for an emptying process, the refuse collection container is configured at a rear end so as to be pivotable about a horizontal axis arranged transversely to a forward direction of movement of the sweeping machine, the refuse collection container having a rear wall with an inner face configured as a sliding surface which rises to the rear of the sweeping machine, wherein the suction air unit is arranged on an outer face of the rear wall of the refuse collection container configured with the sliding surface.

2. The sweeping machine according to claim 1, wherein the upper container wall is line-connected to the adjacent screening device to form a first portion, arranged upstream of the suction air unit, of an air outlet line which is connected to the suction air unit for the suction air separated from the refuse.

3. The sweeping machine according to claim 1, wherein a conveying end of the suction line is configured with an outlet diffusor that protrudes into the refuse collection container and deflects the suction air to a floor of the refuse collecting container.

4. The sweeping machine according to claim 3, wherein the outlet diffusor is hood-shaped and has an outlet opening oriented toward the floor of the container.

5. The sweeping machine according to claim 2, wherein a second portion which is positioned downstream of the suction air unit in an intermediate portion of the air outlet line forms an outlet opening at an end of the air outlet line.

6. The sweeping machine according to claim 5, wherein the second portion of the air outlet line terminates below the refuse collection container.

7. The sweeping machine according to claim 5, wherein the second portion of the air outlet line runs along a lower face of the refuse collection container.

8. The sweeping machine according to claim 5, wherein the outer face of the rear wall of the refuse collection container is configured for arranging the intermediate portion of the air outlet line, which is formed from a line-connected suction air unit, the first portion and the second portion.

9. The sweeping machine according to claim 8, wherein the rear wall is inclined and the suction air unit includes a rotating suction air blower having a rotational axis arranged substantially perpendicular to the inclined rear wall of the refuse collection container on the inclined rear wall outer face.

10. The sweeping machine according to claim 9, wherein the suction air blower has an intake opening provided in the intermediate portion of the air outlet line formed by the suction air unit.

11. The sweeping machine according to claim 10, wherein the intake opening is assigned to the first portion of the air outlet line.

12. The sweeping machine according to claim 10, wherein an offset air outlet opening, which is line-connected to the second portion of the air outlet line, is assigned to the suction air blower.

13. The sweeping machine according to claim 10, wherein the intermediate portion of the air outlet line is configured by a chute that is arranged on the outer face of the rear wall upstream of the suction air blower and extends so as to taper downwardly toward an intake opening.

14. The sweeping machine according to claim 5, further comprising a container cover provided in the upper container wall for emptying the refuse collection container, configured so as to be pivotable about a horizontal axis running transversely to the forward direction of movement and has a line connection that is separable from the intermediate portion of the air outlet line, wherein the upper container wall forming the part of the first portion of the air outlet line and the screening device are arranged on the container cover.

* * * * *